US009727067B2

(12) United States Patent
Fujiwara et al.

(10) Patent No.: US 9,727,067 B2
(45) Date of Patent: Aug. 8, 2017

(54) CHARGING DEVICE INCLUDING REGULATOR CIRCUIT AND INTEGRATED CIRCUIT

(71) Applicant: ROHM CO., LTD., Ukyo-Ku, Kyoto (JP)

(72) Inventors: Akira Fujiwara, Kyoto (JP); Takashi Kimura, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 52 days.

(21) Appl. No.: 14/833,418

(22) Filed: Aug. 24, 2015

(65) Prior Publication Data

US 2016/0054749 A1 Feb. 25, 2016

(30) Foreign Application Priority Data

Aug. 25, 2014 (JP) ..... 2014-170333

(51) Int. Cl.
*G05F 1/575* (2006.01)
*G05F 1/59* (2006.01)

(52) U.S. Cl.
CPC ..... *G05F 1/59* (2013.01)

(58) Field of Classification Search
CPC ..... G05F 1/461; G05F 1/462; G05F 1/565; G05F 1/575
USPC ..... 323/273, 275, 281
See application file for complete search history.

(56) References Cited

U.S. PATENT DOCUMENTS 8,093,875 B2 * 1/2012 Sun ..... H02J 1/08 323/281
8,686,701 B2 * 4/2014 Ting ..... H02M 3/156 323/282
2005/0248391 A1 * 11/2005 Itoh ..... G05F 1/575 327/540
2009/0134852 A1 * 5/2009 Sun ..... G05F 1/575 323/234
2013/0027987 A1 * 1/2013 Yang ..... H02M 3/33592 363/21.14
2015/0035510 A1 * 2/2015 Hoshino ..... H02M 3/157 323/283
2016/0054749 A1 * 2/2016 Fujiwara ..... G05F 1/59 323/273

FOREIGN PATENT DOCUMENTS

JP 2009213329 A 9/2009

* cited by examiner

*Primary Examiner* — Jeffrey Sterrett
(74) *Attorney, Agent, or Firm* — Cantor Colburn LLP

(57) ABSTRACT

A regulator circuit includes: a regulator part configured to generate a constant internal power supply voltage based on an external power supply voltage; a connection port configured to receive power from the regulator part and to be connected to a connection cable having a predetermined cable resistance, the connection cable is configured to electrically connect the connection port to an external device; a current detecting part configured to detect a power supply current when the connection cable is connected to the connection port; and a voltage compensation part configured to compensate a voltage corresponding to a voltage drop due to the cable resistance according to a current value detected by the current detecting part.

7 Claims, 7 Drawing Sheets

FIG. 5

| Rcable[Ω] | Rcal[Ω] |
|---|---|
| 0.000 | 0 |
| 0.101 | 62 |
| 0.122 | 75 |
| 0.133 | 82 |
| 0.148 | 91 |
| 0.162 | 100 |
| 0.180 | 110 |
| 0.195 | 120 |
| 0.211 | 130 |
| 0.244 | 150 |
| 0.261 | 150 |
| 0.294 | 180 |
| 0.325 | 200 |
| 0.358 | 220 |
| 0.381 | 240 |
| 0.440 | 270 |
| 0.489 | 300 |
| 0.538 | 330 |
| 0.586 | 360 |
| 0.635 | 390 |
| 0.700 | 430 |

CHARGING DEVICE INCLUDING REGULATOR CIRCUIT AND INTEGRATED CIRCUIT

CROSS-REFERENCE TO RELATED APPLICATIONS

The present invention claims priority under 35 U.S.C. §119 to Japanese Application No. 2014-170333, filed on Aug. 25, 2014, the entire content of which is incorporated herein by reference.

TECHNICAL FIELD

The present disclosure relates to a regulator circuit and an integrated circuit.

BACKGROUND

Charging devices for charging a variety of portable devices, such as a smartphone, a tablet terminal, and the like, which are equipped with a secondary battery (such as a lithium battery), via a USB (Universal Serial Bus) port has been wide spread.

The charging current that is supplied from the USB port is generally 1 A or less. Recently, power supply circuits and charging devices capable of supplying a charging current of 2.1 A to allow quick charging are being developed.

A variety of techniques related to such charging devices are often being proposed.

However, when the charging current is increased from 1 A to 2.1 A as described above, a voltage drop due to the cable resistance between a power supply circuit (power supply board) and a USB connector of a portable device to be charged is increased.

Due to the increased voltage drop, there is a problem that the requirement of a voltage reference (5 V±5%, i.e., 4.75 V−5.25 V) defined in the USB standard (USB power supply standard) is not satisfied.

SUMMARY

The present disclosure provides some embodiments of a regulator circuit and an integrated circuit which are capable of compensating an output voltage in response to a load current with regard to a voltage drop due to cable resistance, thus allowing a predetermined reference voltage to be retained, and achieving reduced costs and downsizing.

According to one embodiment of the present disclosure, there is provided a regulator circuit including: a regulator part configured to generate a constant internal power supply voltage based on an external power supply voltage; a connection port configured to receive power from the regulator part and to be connected to a connection cable having a predetermined cable resistance, the connection cable is configured to electrically connect the connection port to an external device; a current detecting part configured to detect a power supply current when the connection cable is connected to the connection port; and a voltage compensation part configured to compensate a voltage corresponding to a voltage drop due to the cable resistance according to a current value detected by the current detecting part, wherein the current detecting part includes a current detecting transistor, the voltage compensation part includes an output transistor which is current mirror-connected with the current detecting transistor, and a compensation amount setting resistor connected to the output side of the current detecting transistor for setting a compensation amount, and, when the mirror ratio of the current detecting transistor and the output transistor is m1:m2, the transistor sizes are selected to meet the relationship of m1<m2.

Each of the current detecting transistor and the output transistor may include a pMOS transistor.

A voltage generated in the compensation amount setting resistor based on a load current output from a source electrode of the current detecting transistor may be fed back to a gate electrode of the current detecting transistor to compensate an output voltage of the output transistor which is current mirror-connected with the current detecting transistor.

The resistance (Rcal) of the compensation amount setting resistor may be determined according to the following equation:

$$Rcal = Rcable \times A \times ((R1+R2)/(R1) \times (Rf2/(Rf1+Rf2))$$

where Rcable denotes the cable resistance, A denotes a mirror ratio, R1 and R2 denote resistance of voltage dividing resistors connected to the gate electrode of the current detecting transistor, and Rf1 and Rf2 denote resistance of reference resistors connected to the output side of the output transistor.

The connection cable may be a cable conforming to the USB standard.

The compensation amount setting resistor may be a variable resistor.

According to another embodiment of the present disclosure, there is provided an integrated circuit including the above-described regulator circuit.

The integrated circuit may further include a DC/DC converter configured to convert an external DC voltage to a predetermined voltage, wherein a DC voltage converted by the DC/DC converter is input to the regulator circuit.

BRIEF DESCRIPTION OF THE DRAWINGS

FIG. 5 illustrates a table showing numerical examples of Rcal and Rcable in a regulator circuit according to one embodiment of the present disclosure.

DETAILED DESCRIPTION

Figure 1:
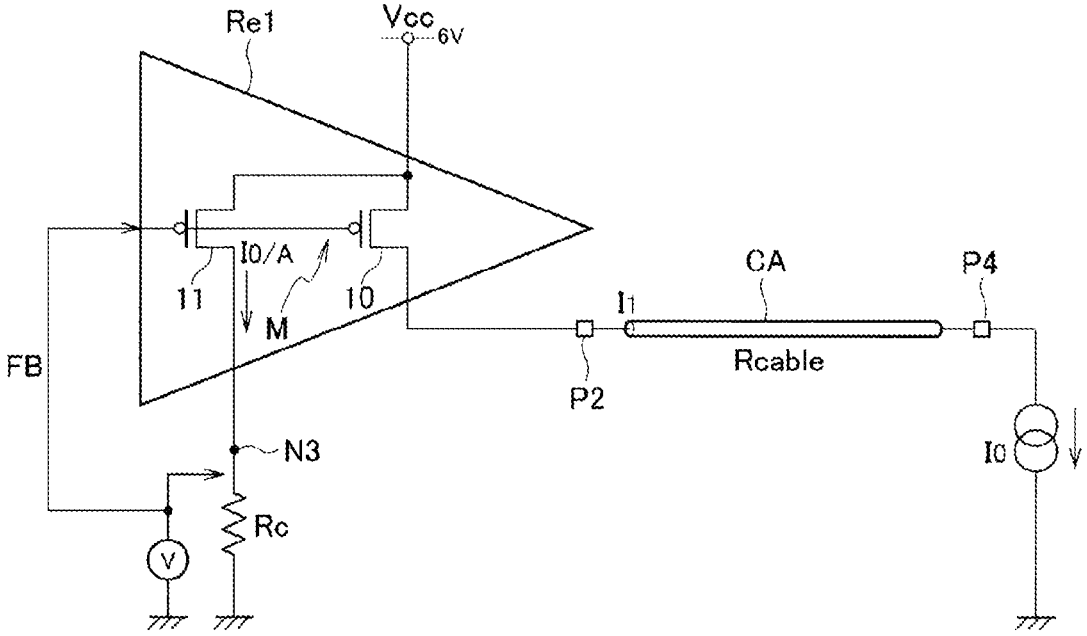
FIG. 1 illustrates a schematic circuit diagram showing an exemplary configuration of a regulator circuit according to one embodiment of the present disclosure.

Embodiments of the present disclosure will now be described in detail with reference to the drawings. Throughout the drawings, the same or similar elements are denoted by the same or similar reference numerals. It should be noted that the drawings merely show schematics, and thus, thickness, planar dimension of elements, thickness ratio of various layers, etc. may be modified. Accordingly, the specific thickness and dimensions should be determined in consideration of the following descriptions. In addition, it is to be understood that the drawings include different dimensional relationships and ratios.

The following embodiments are provided to illustrate devices and methods to embody the technical ideas of the present disclosure and are not limited to materials, forms, structures, arrangements, etc. of elements herein. The embodiments of the present disclosure may be modified in different ways without departing from the spirit and scope of the invention defined in the claims.

(Regulator Circuit)

Prior to the describing a regulator circuit 1 and an integrated circuit according to embodiments of the present disclosure, a regulator circuit in a device for charging a portable device via a USB cable will be described with reference to FIGS. 7 and 8.

Figure 7:
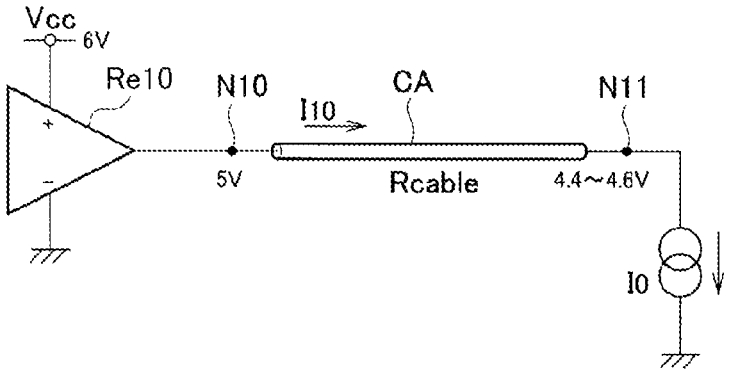
FIG. 7 illustrates a schematic circuit diagram showing an exemplary configuration of a regulator circuit.

In the exemplary configuration shown in FIG. 7, a regulator circuit Re10 receives a power supply voltage of 6 V and outputs a voltage of 5 V.

In this example, the power supply voltage may be obtained by transforming and rectifying a voltage from an AC power source or converting a 12 V DC voltage from a vehicle battery by using a DC/DC converter.

When a connection cable CA is connected between nodes N10 and N11, a charging current may be supplied to a variety of portable devices (not shown), such as a smartphone, a tablet terminal, etc. that are equipped with a secondary battery (such as a lithium battery), as a DC constant current source I0.

The connection cable CA used herein is a USB (Universal Serial Bus) cable conforming to the USB standard.

In this case, the USB Power Delivery section of the USB power supply standard stipulates that a voltage of 5 V±5% (i.e., 4.75 V–5.25 V) should be supplied to a USB port to which the constant current source I0 is connected.

Although a charging current supplied from the USB port is generally 1 A or less, a charging current of 2.1 A may also be used to allow quick charging. When the charging current is increased from 1 A to 2.1 A, a voltage drop caused by the cable resistance Rcable of the connection CA cable is relatively large.

In particular, since the cable resistance of the connection cable CA is typically about 0.2 to 0.3Ω, the voltage drop is about 0.4 to 0.6 V when the current $I_{10}$ flowing through the connection cable CA is 2.1 A.

Therefore, in the example shown in FIG. 7, when a voltage at the node N10 is 5 V, a voltage at the node N11 through the connection cable CA is about 4.4 to 4.6 V, which is insufficient to meet the requirement of 4.75 V to 5.25 V, due to the voltage drop described above.

Figure 8:
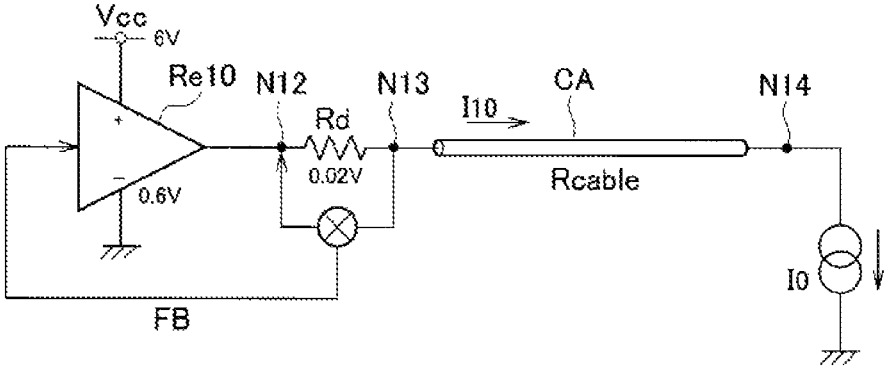
FIG. 8 illustrates a schematic circuit diagram showing another exemplary configuration of a regulator circuit.

In order to avoid such problem, the exemplary configuration shown in FIG. 8 increases the voltage to compensate the voltage drop due to the connection cable CA.

In particular, in the example shown in FIG. 8, a detection resistor Rd is connected in series to the output side of the regulator circuit Re10.

The detection resistor Rd has resistance of about 20 mΩ so as to minimize the effect of voltage drop due to the detection resistor Rd.

In this example, when the power supply voltage is 6 V and the current $I_{10}$ is 1 A, a difference in the voltage between the input and output side of the regulator circuit Re10 is about 0.6 V and the voltage drop across the detection resistor Rd (a difference in voltage between nodes N12 and N13 is about 0.02 V.

In the example shown in FIG. 8, in order to compensate for the voltage difference of about 0.62 V, a feedback signal is forwarded to the regulator circuit Re10 through a feedback circuit FB, thereby controlling the amplification factor for the output voltage.

Thus, the voltage at the node N14 that is connected to the connection cable CA may be adjusted to meet the requirement of 4.75 V to 5.25 V.

However, in the exemplary configuration shown in FIG. 8, it is necessary to use a relatively expensive resistor having a resistance of about 20 mΩ for the detection resistor Rd, which results in increased production costs. In particular, it is necessary to use a high-precision resistor having a low resistance deviation in order to increase the precision of detection, which results in a further increase in production costs.

In addition, resistors that have low resistance are generally designed to withstand high current, which require a relatively large volume or installation area. Therefore, for example, when the regulator circuit shown in FIG. 8 is equipped in a charger of a portable device, the size of the device is likely to be increased.

The regulator circuit 1 according to one embodiment provides a regulator circuit and an integrated circuit which are capable of compensating an output voltage in response to a load current with regard to a voltage drop due to cable resistance, maintaining a predetermined reference voltage, and reducing cost and size.

(Schematic Configuration of Regulator Circuit according to one Embodiment)

The schematic configuration of the regulator circuit 1 according to one embodiment of the present disclosure will now be described with reference to FIG. 1.

FIG. 1 illustrates is a schematic circuit diagram showing an exemplary configuration of the regulator circuit 1 according to one embodiment of the present disclosure.

The regulator circuit 1 shown in FIG. 1 includes a regulator part Re1 that generates a constant internal power supply voltage based on an external power supply voltage Vcc (e.g., 6 V), connection ports P2 and P4 that may be connected to a connection cable CA having a predetermined cable resistance and supplied with the power output of the regulator part Re1 for electrically connecting the regulator part Re1 and an external device (not shown) such as a portable terminal, a current detecting part for detecting a power supply current when the connection cable CA is connected to the connection ports P2 and P4, and a voltage compensation part for compensating a voltage corresponding to a voltage drop due to the cable resistance according to a current value detected by the current detecting part.

In this embodiment, the connection cable CA is a USB cable conforming to the USB standard.

In the regulator circuit 1 shown in FIG. 1, the current detecting part includes a current detecting transistor 11. The voltage compensation part includes an output transistor 10 current mirror-connected with the current detecting transistor 11 to form a current mirror circuit M, and a compensation amount setting resistor Rc that is connected to the output side of the current detecting transistor 11 to set a compensation amount.

When the mirror ratio of the current detecting transistor 11 and the output transistor 10 is m1:m2, the size of the transistors are selected to meet the relationship of m1<m2.

The mirror ratio (m1:m2) may be, for example, 1:10000.

Each of the current detecting transistor 11 and the output transistor 10 may be a pMOS transistor.

The mirror ratio may also be an aspect ratio (W/L) of each of the transistors 10 and 11, where W denotes a gate width and L denotes a gate length.

In the regulator circuit 1 shown in FIG. 1, a voltage generated in the compensation amount setting resistor Rc based on a load current I0/A (A is the mirror ratio) from the source electrode of the current detecting transistor 11 is fed back to the gate electrode of the current detecting transistor 11 through a feedback circuit FB, thereby compensating the output voltage of the output transistor 10 that is current mirror-connected to the current detecting transistor 11.

In this embodiment, when the resistance Rcable of the USB cable is about 0.2 to 0.3Ω and the output current I0 is 2 A, the load current I0/A is about 200 μA and the resistance Rcal of the compensation amount setting resistor Rc is, for example, about several hundredths of an Ω.

A method for calculating the resistance Rcal of the compensation amount setting resistor Rc will be described in detail later.

Thus, according to the regulator circuit 1 shown in FIG. 1, the resistance Rcal of the compensation amount setting resistor Rc is, for example, about several hundredths of an Ω, and, therefore, a general and relatively inexpensive resistor may be used. Thus, there is no need to use a resistor having low resistance (for example, about 20 mΩ), which is relatively expensive and requires a relatively large installation area as described with reference to FIG. 8, and it is possible to provide a regulator circuit that may be relatively inexpensive and compact.

In addition, the compensation amount setting resistor Rc may be a variable resistor and the resistance Rcal of the compensation amount setting resistor Rc may be adjusted according to the resistance Rcable of the USB cable CA.

(Details of Regulator Circuit according to One Embodiment)

Details of the regulator circuit 1 according to one embodiment of the present disclosure will be described with reference to FIG. 2.

Figure 2:
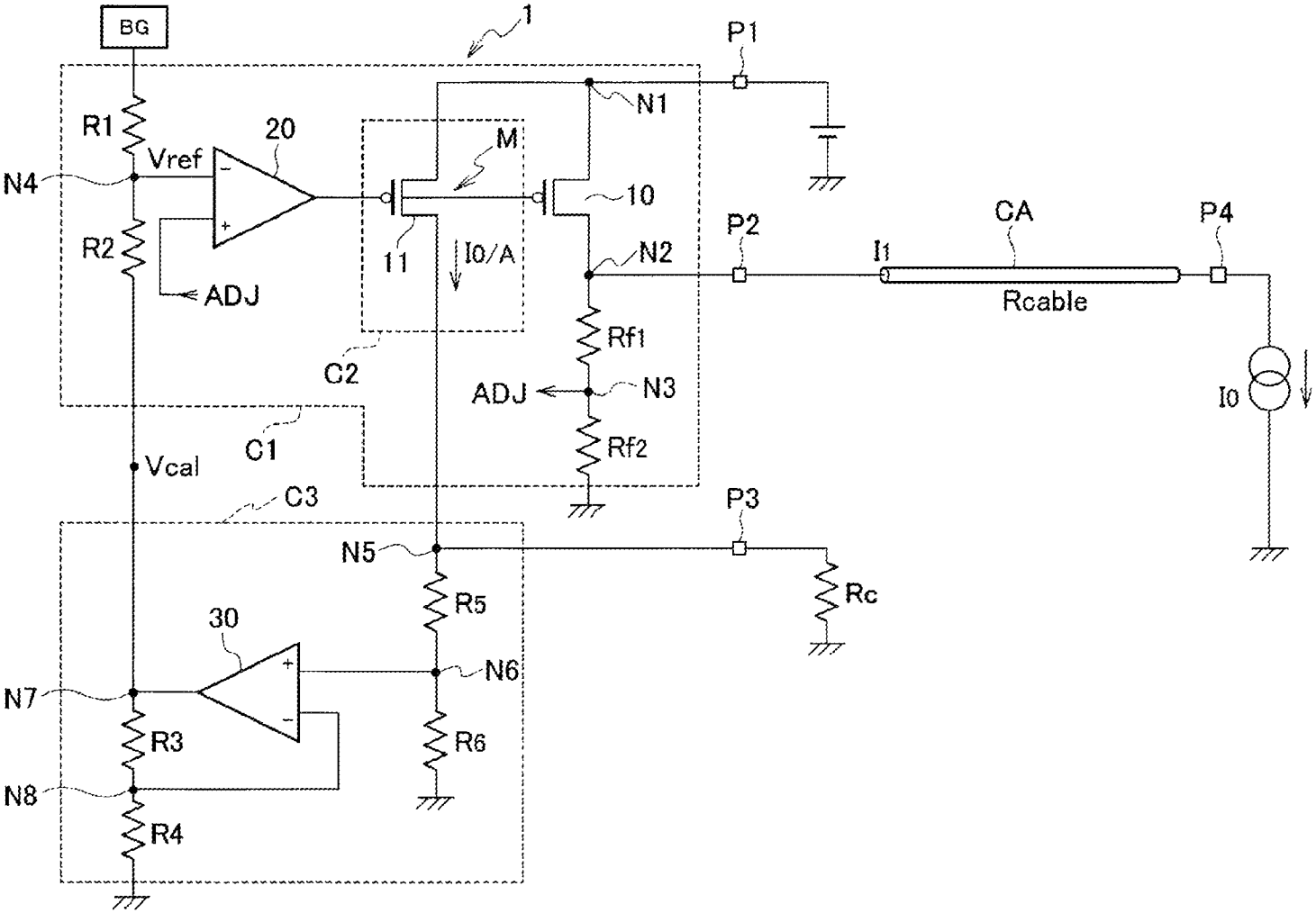
FIG. 2 illustrates a circuit diagram showing details of a regulator circuit according to one embodiment of the present disclosure.

FIG. 2 illustrates a circuit diagram showing details of the regulator circuit 1 according to one embodiment of the present disclosure.

The regulator circuit 1 shown in FIG. 2 includes a regulator part C1 that generates a constant internal power supply voltage based on an external power supply voltage, connection ports P2 and P4 that may be connected to a connection cable CA having a predetermined cable resistance and supplied with power output of the regulator part C1 for electrically connecting the regulator part C1 and an external device (not shown), a current detecting part C2 for detecting a power supply current when the connection cable CA is connected to the connection ports P2 and P4, a voltage compensation part including the compensation amount setting resistor Rc for compensating a voltage corresponding to a voltage drop due to the cable resistance according to a current value detected by the current detecting part C2, and a voltage converting/amplifying part C3 for suppressing the variation of a voltage difference ΔV in the current mirror circuit M.

The regulator part C1 contains the current detecting part C2, which includes the current detecting transistor 11.

The output transistor 10 is current mirror-connected to the current detecting transistor 11 to form the current mirror circuit M.

The current detecting transistor 11 and the output transistor 10 may be pMOS transistors.

When the mirror ratio of the current detecting transistor 11 and the output transistor 10 is m1:m2, the size of transistors are selected to meet the relationship of m1<m2.

A comparator 20 is connected to the gate terminal of the current detecting transistor 11. A reference voltage Vref is input to the negative (−) terminal of the comparator 20. The positive (+) terminal of the comparator 20 is connected to an adjusting terminal (output voltage adjusting terminal) ADJ (not shown).

Voltage dividing resistors R1 and R2 are connected to the negative terminal of the comparator 20 via a node N4, one end of the voltage dividing resistor R1 is connected to a band gap voltage BG, and one end of the voltage dividing resistor R2 is connected to a resistor R3 of the voltage converting/amplifying part C3.

The reference voltage Vref appears at a connection point (node N4) of the voltage dividing resistors R1 and R2 and a voltage Vcal according to the compensation amount setting resistance Rc and the load current I0/A appears at a connection point of the voltage dividing resistor R2 and the resistor R3.

The drain terminals of the current detecting transistor 11 and the output transistor 10 are connected to a power supply voltage (e.g., 6 V) via a node N1 and a port P1.

The source terminal of the current detecting transistor 11 is connected to the compensation amount setting resistor Rc via a node N5 and a port P3. The other end of the compensation amount setting resistor Rc is grounded.

Voltage dividing resistors R5 and R6 of the voltage converting/amplifying part C3 are connected to the node N5.

The positive (+) terminal of a comparator 30 serving as a buffer amplifier is connected to a connection point (node N6) of the voltage dividing resistors R5 and R6. The negative (−) terminal of the comparator 30 is connected to a connection point (node N8) of the resistors R3 and R4 and one end of each of the resistors R4 and R6 is grounded.

The connection cable CA (e.g., a USB cable), which has the cable resistance Rcable, is connected to the source terminal of the output transistor 10 via the node N2 and the port P2. A current I1 flowing through the connection cable CA corresponds to an amount of current obtained by compensating the effect of the voltage drop due to the cable resistance Rcable. In particular, the amount of current I1 is compensated such that the output current becomes 2A to allow an external device (not shown; e.g., a terminal such as a smartphone) to be quickly charged.

Reference resistors Rf1 and Rf2 are connected to the node N2. The other end of Rf2 is grounded and a connection point (node N3) of the reference resistors Rf1 and Rf2 is connected to the adjusting terminal ADJ (not shown).

In the regulator circuit 1, the resistance Rcal of the compensation amount setting resistor Rc is set according to the following equation 1.

$$Rcal = Rcable \times A \times ((R1+R2)/R1) \times (Rf2/(Rf1+Rf2)) \quad \text{[Equation 1]}$$

Where, Rcable denotes the cable resistance, A denotes the mirror ratio of the current detecting transistor 11 and the output transistor 10, R1 and R2 denote the resistance of the voltage dividing resistors connected to the gate electrode of the current detecting transistor, and Rf1 and Rf2 denote the resistance of the reference resistors Rf1 and Rf2 connected to the output side of the output transistor.

Equation 1 is derived from the following relationship.

In other words, a cable voltage drop compensation amount (ΔVcal) is expressed by Equation 2.

$$\Delta Vcal = (I0/A) \times Rcal \times (R1/(R1+R2)) \times ((Rf1+Rf2)/Rf2) \quad \text{[Equation 2]}$$

Where, I0/A denotes the load current, Rcal denotes the resistance of the compensation amount setting resistor Rc, A denotes the mirror ratio of the current detecting transistor 11 and the output transistor 10, R1 and R2 denote the resistance of the voltage dividing resistors R1 and R2 connected to the gate electrode of the current detecting transistor 11, and Rf1 and Rf2 denote resistance of the reference resistors Rf1 and Rf2 connected to the output side of the output transistor.

Rcal to make the cable voltage drop compensation amount (ΔVcal) equal to the voltage drop (Rcable×I0) in the connection cable CA is obtained from Equation 3.

$$Rcable \times I0 = (I0/A) \times Rcal \times (R1/(R1+R2)) \times ((Rf1+Rf2)/Rf2) \quad \text{[Equation 3]}$$

The above Equation 1 can be obtained by modifying Equation 3.

In Equation 2, (I0/A)×Rcal corresponds to the voltage Vcal in FIG. 2. (I0/A)×Rcal×(R1/(R1+R2)) corresponds to ΔADJ, which can be adjusted in the adjusting terminal (output voltage adjusting terminal) ADJ.

When the mirror ratio of the current detecting transistor 11 and the output transistor 10 is 1:10000, the output current I0 is 2 A, the resistance Rcable of the USB cable is about 0.7Ω and the voltage dividing resistors R1 and R2 and the reference resistors Rf1 and RF2 having appropriate resistance are used, Rcal is calculated to be about 430Ω according to Equation 1.

When the compensation amount setting resistor Rc is a variable resistor, by setting its resistance to about 430Ω, it is possible to compensate for the voltage drop (Rcable×I0) in the connection cable CA and obtain the output current of about 2 A to meet the USB standard.

Thus, according to the regulator circuit 1 shown in FIG. 2, the resistance Rcal of the compensation amount setting resistor Rc is, for example, about 430Ω, and, therefore, a typical and relatively inexpensive resistor may be used. Therefore, with no need to use a resistor having low resistance (for example, about 20 mΩ) which is relatively expensive and requires a relatively large installation area as described above with reference to FIG. 8, it is possible to provide a regulator circuit that may be relatively inexpensive and compact.

Figure 3:
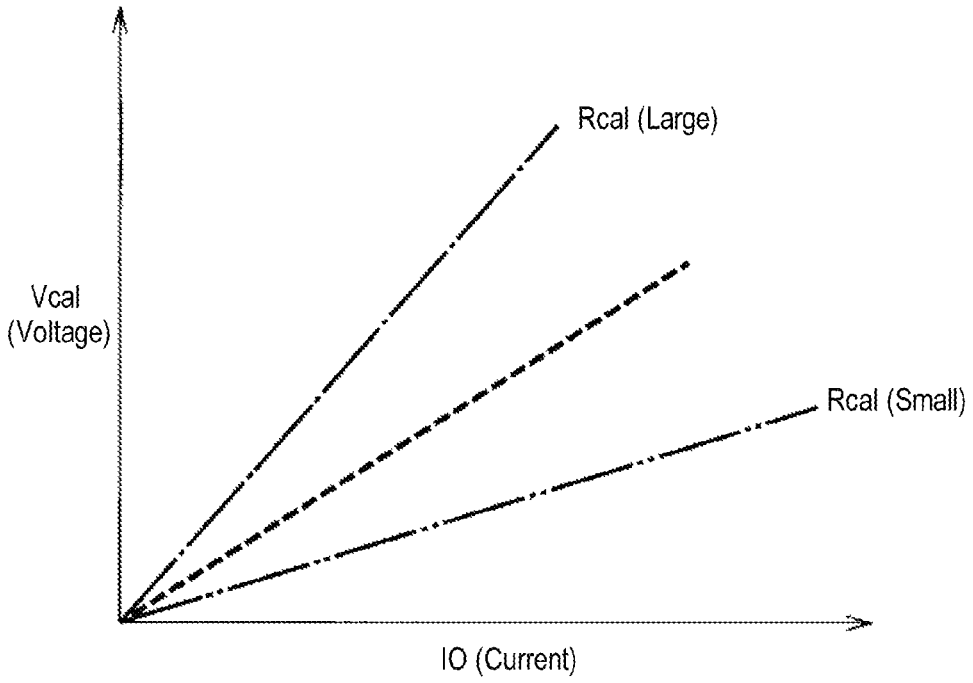
FIG. 3 illustrates a graph showing the relationship between Vcal and I0 in a regulator circuit according to one embodiment of the present disclosure.

FIG. 3 is illustrates a graph showing the relationship between Vcal and I0 in the regulator circuit 1 according to one embodiment of the present disclosure.

As shown in FIG. 3, it is necessary to increase the resistance Rcal of the compensation amount setting resistor Rc in order to increase the amount of the output current I0.

Figure 4:
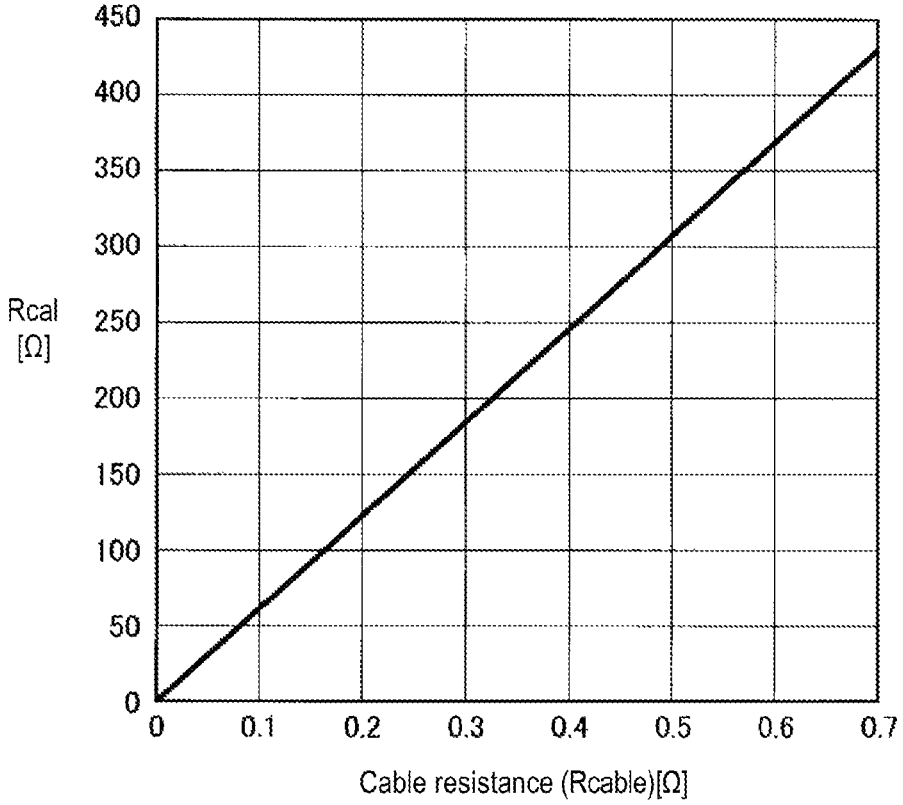
FIG. 4 illustrates a graph showing the relationship between Rcal and Rcable in a regulator circuit according to one embodiment of the present disclosure.

FIG. 4 illustrates a graph showing the relationship between Rcal and Rcable in the regulator circuit 1 according to one embodiment of the present disclosure and FIG. 5 illustrates a table showing numerical examples of Rcal and Rcable in the regulator circuit 1 according to one embodiment of the present disclosure.

Here, Equation 1 can be replaced by the approximate expression shown in Equation 4.

$$Rcal \times Rcable \times 614 \quad \text{[Equation 4]}$$

The graph of FIG. 4 is obtained by graphing the linear function represented by Equation 4. The table of FIG. 5 shows an example of approximate values of the calculation result according to Equation 4.

As described above, with the regulator circuit 1 according to one embodiment of the present disclosure, it is possible to compensate the output voltage in response to the load current I0/A with regard to the voltage drop due to the cable resistance Rcable, thus allowing a predetermined reference voltage to be retained, and achieving reduced costs and downsizing.

(Exemplary Configuration of Integrated Circuit Using Regulator Circuit according to Embodiment)

Figure 6:
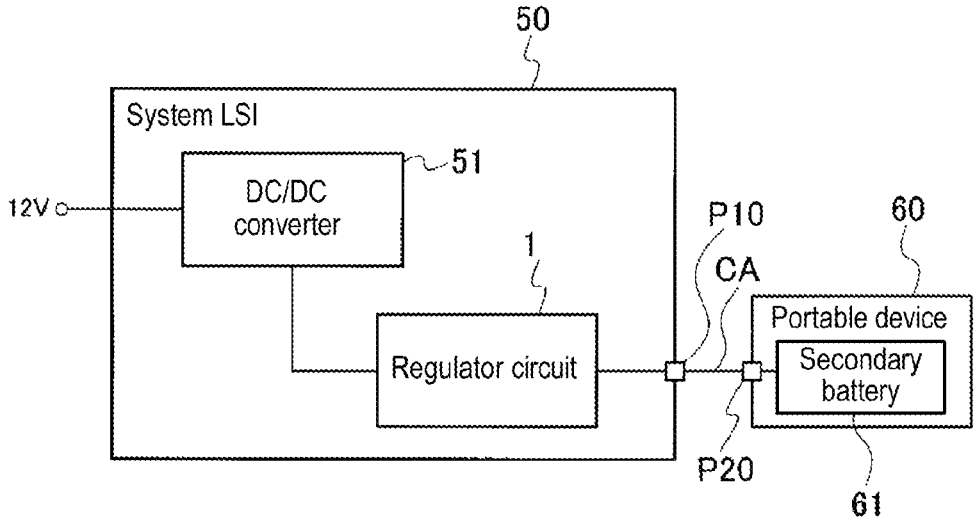
FIG. 6 illustrates a block diagram showing an exemplary configuration of a system LSI equipped with a regulator circuit according one embodiment of the present disclosure.

FIG. 6 illustrates a block diagram showing an exemplary configuration of a system LSI 50, which is a type of integrated circuit equipped with the regulator circuit 1 according to one embodiment of the present disclosure.

The system LSI 50 is used as a power supply IC of a car audio device or the like mounted on a vehicle or the like.

In the example shown in FIG. 6, the system LSI 50 includes a DC/DC converter 51 for converting a DC voltage of 12 V supplied from an on-vehicle battery or the like to 6 V, and a regulator circuit 1 as shown in FIG. 2.

The system LSI 50 is connected to a port (e.g., USB port) P20 of a portable device 60 (e.g., a smartphone) via a connection cable CA (e.g., a USB cable) connected to a port (e.g., USB port) P10.

The portable device 60 such as the smartphone is equipped with a secondary battery 61 such as a lithium ion battery, which is adapted to be charged with a charging current supplied from the regulator circuit 1 of the system LSI 50 via the connection cable CA.

As described above, the regulator circuit 1 according to one embodiment of the present disclosure may use a typical and relatively inexpensive resistor for the compensation amount setting resistor Rc having the resistance Rcal, for example, of about several hundredths of an Ω. Therefore, with no need to use a resistor having a low resistance (for example, about 20 mΩ) that is relatively expensive and requires a relatively large installation area, it is possible to provide a regulator circuit that may be relatively inexpensive and compact.

Therefore, the system LSI 50 including the regulator circuit 1 according to one embodiment may also be made compact at low costs due to the advantages of the regulator circuit 1.

Other Embodiments

As described above, e present disclosure has been illustrated by way of some embodiments, but the description and drawings which constitute a part of this disclosure are exemplary and should not be construed to limit the present disclosure. Various alternative embodiments, examples and operation techniques will be apparent to those skilled in the art from this disclosure.

Thus, the present disclosure includes other different embodiments which are not described herein.

The regulator circuit and the integrated circuit of the previously described embodiments may be applied to system power supplies for car audio, chargers of portable devices, etc.

According to the embodiments of the present disclosure, it is possible to provide a regulator circuit and an integrated circuit that are capable of compensating an output voltage in response to a load current with regard to a voltage drop due to cable resistance, thus allowing a predetermined reference voltage to be retained, and achieving reduced costs and downsizing.

While certain embodiments have been described, these embodiments have been presented by way of example only, and are not intended to limit the scope of the disclosures. Indeed, the methods and apparatuses described herein may be embodied in a variety of other forms; furthermore, various omissions, substitutions, and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A regulator circuit comprising:

a regulator part configured to generate a constant internal power supply voltage based on an external power supply voltage;

a connection port configured to receive power from the regulator part and to be connected to a connection cable having a predetermined cable resistance, the connection cable is configured to electrically connect the connection port to an external device;

a current detecting part configured to detect a power supply current when the connection cable is connected to the connection port; and a voltage compensation part configured to compensate a voltage corresponding to a voltage drop due to the cable resistance according to a current value detected by the current detecting part, wherein the current detecting part includes a current detecting transistor, wherein the voltage compensation part includes an output transistor which is current mirror-connected with the current detecting transistor, and a compensation amount setting resistor connected to the output side of the current detecting transistor for setting a compensation amount, and wherein, when a mirror ratio of the current detecting transistor and the output transistor is m1:m2, the transistor sizes are selected to meet the relationship of m1<m2, and wherein a voltage generated in the compensation amount setting resistor based on a load current output from a source electrode of the current detecting transistor is fed back to a gate electrode of the current detecting transistor to compensate an output voltage of the output transistor which is current mirror-connected with the current detecting transistor.

2. The regulator circuit of claim 1, wherein each of the current detecting transistor and the output transistor includes a pMOS transistor.

3. The regulator circuit of claim 1, wherein the connection cable is a cable conforming to the USB standard.

4. The regulator circuit of claim 1, wherein the compensation amount setting resistor is a variable resistor.

5. A regulator circuit comprising:

a regulator part configured to generate a constant internal power supply voltage based on an external power supply voltage;

a connection port configured to receive power from the regulator part and to be connected to a connection cable having a predetermined cable resistance, the connection cable is configured to electrically connect the connection port to an external device;

a current detecting part configured to detect a power supply current when the connection cable is connected to the connection port; and a voltage compensation part configured to compensate a voltage corresponding to a voltage drop due to the cable resistance according to a current value detected by the current detecting part, wherein the current detecting part includes a current detecting transistor, wherein the voltage compensation part includes an output transistor which is current mirror-connected with the current detecting transistor, and a compensation amount setting resistor connected to the output side of the current detecting transistor for setting a compensation amount, and wherein, when a mirror ratio of the current detecting transistor and the output transistor is m1:m2, the transistor sizes are selected to meet the relationship of m1<m2, and wherein the resistance (Rcal) of the compensation amount setting resistor is determined according to the following equation:

$$Rcal = Rcable \times A \times ((R1+R2)/(R1) \times (Rf2/(Rf1+Rf2))$$

where Rcable denotes the cable resistance, A denotes a mirror ratio, R1 and R2 denote resistance of voltage dividing resistors connected to a gate electrode of the current detecting transistor, and Rf1 and Rf2 denote resistance of reference resistors connected to the output side of the output transistor.

6. An integrated circuit comprising a regulator circuit which includes:

a regulator part configured to generate a constant internal power supply voltage based on an external power supply voltage;

a connection port configured to receive power from the regulator part and to be connected to a connection cable having a predetermined cable resistance, the connection cable is configured to electrically connect the connection port to an external device;

a current detecting part configured to detect a power supply current when the connection cable is connected to the connection port; and a voltage compensation part configured to compensate a voltage corresponding to a voltage drop due to the cable resistance according to a current value detected by the current detecting part, wherein the current detecting part includes a current detecting transistor, wherein the voltage compensation part includes an output transistor which is current mirror-connected with the current detecting transistor, and a compensation amount setting resistor connected to the output side of the current detecting transistor for setting a compensation amount, and wherein, when a mirror ratio of the current detecting transistor and the output transistor is m1:m2, the transistor sizes are selected to meet the relationship of m1<m2, and wherein a voltage generated in the compensation amount setting resistor based on a load current output from a source electrode of the current detecting transistor is fed back to a gate electrode of the current detecting transistor to compensate an output voltage of the output transistor which is current mirror-connected with the current detecting transistor.

7. The integrated circuit of claim 6, further comprising a DC/DC converter configured to convert an external DC voltage to a predetermined voltage, wherein a DC voltage converted by the DC/DC converter is input to the regulator circuit.

* * * * *